US006173142B1

(12) United States Patent
Kawakami

(10) Patent No.: US 6,173,142 B1
(45) Date of Patent: Jan. 9, 2001

(54) IMAGE FORMING APPARATUS

(75) Inventor: Tomoyuki Kawakami, Niigata (JP)

(73) Assignee: NEC Corporation, Tokyo (JP)

( * ) Notice: Under 35 U.S.C. 154(b), the term of this patent shall be extended for 0 days.

(21) Appl. No.: 09/468,521

(22) Filed: Dec. 21, 1999

(30) Foreign Application Priority Data

Dec. 22, 1998 (JP) ..... 10-364329

(51) Int. Cl.[7] ..... G03G 15/02; G03G 21/00

(52) U.S. Cl. ..... 399/175; 399/174; 399/115; 361/225

(58) Field of Search ..... 399/175, 174, 399/176, 115; 361/225; 428/82, 88

(56) References Cited

U.S. PATENT DOCUMENTS 4,457,615 * 7/1984 Seanor .
4,741,942 * 5/1988 Swift ..... 428/82
5,633,701 * 5/1997 Yoshida ..... 399/175

FOREIGN PATENT DOCUMENTS 57-65347 of 0000 (JP) .
60-151664 8/1985 (JP) .
60-216363 10/1985 (JP) .
3-130787 6/1991 (JP) .
4-142566 5/1992 (JP) .
4-366863 12/1992 (JP) .
7-72774 3/1995 (JP) .
7-104562 4/1995 (JP) .
7-306571 11/1995 (JP) .
8-137207 5/1996 (JP) .
8-185011 7/1996 (JP) .
8-254877 10/1996 (JP) .
10-221932 8/1998 (JP) .

* cited by examiner

*Primary Examiner*—Richard Moses
(74) *Attorney, Agent, or Firm*—Ostrolenk, Faber, Gerb & Soffen, LLP

(57) ABSTRACT

An image forming apparatus having a roller-shaped charging brush includes a first member for raising the brush pile and cleaning it while rotating in contact with the roller-shaped charging brush and a second member located at a position following the first member in the rotation direction of the roller-shaped charging brush, for shaping the brush pile raised by the first member while contacting with the roller-shaped charging brush. A combination of the first and second members can provide a satisfactory charging function at all times.

14 Claims, 5 Drawing Sheets

IMAGE FORMING APPARATUS

BACKGROUND OF THE INVENTION

1. Field of the Invention

The present invention relates to an image forming apparatus using an electrophotographic process, particularly, relates to an image forming apparatus having a mechanism for satisfactorily maintaining a function of a roller-shaped charging brush.

2. Description of the Related Art

There have been known, as a conventional image forming apparatus, an apparatus using an electrophotographic process such as a copy machine, a facsimile, an electrophotographic apparatus or an electrostatic printer. In general, the image forming apparatus is provided with a process cartridge which has a photoreceptor drum and a developed device for allowing toner to be adsorbed onto an electrostatic latent image formed on a surface of the photoreceptor drum so as to develop the image. The process cartridge has a toner housing chamber and a developing chamber which are adjacent to each other. A connecting opening which connects the toner housing chamber and the developing chamber is formed in a separation board between the toner housing chamber and the developing chamber, and a toner mixer for feeding toner from the connecting opening to the side of the developing chamber is provided in the toner housing chamber.

In the process cartridge of the convention image forming apparatus, a non-contact type corona charger which utilizes corona discharge has been used as a charger for charging a body to be charged such as a photoreceptor drum prior to form an electrostatic latent image thereon. The corona charger is effective as means for uniformly charging the body to be charged, but at the same time it has a disadvantage that the discharge causes generation of ozone.

There has been known a contact type charger which can suppress the generation of ozone. Since the contact type charger, particularly, a rotating charger shaped like a roller can charge the surface of the photoreceptor more uniformly than a fixed charger, this rotating charger is utilized in a lot of apparatuses.

In recent years, since a particle diameter of toner becomes smaller according to the heightening of resolution of electrophotography and lifetime becomes longer according to the lowering of the cost of a process cartridge, it is important to maintain uniform charging for a long period. Since the contact type charger always contacts with the surface of the photoreceptor, it is easily influenced by toner or paper powder which remains on the surface of the photoreceptor, shavings of the photoreceptor or the like after development, and thus various measures are taken in order to execute the uniform charging for a long period.

In an apparatus disclosed in Japanese Patent Application Laid Open No. 8 254877, a rotating brush charger is oscillated in a direction of a rotating shaft and simultaneously brush pile is brought into contact with a photoreceptor, and an extended length of the brush pile from a brush charger main body is made to be uniform so that a cleaning effect for the surface of the photoreceptor is heightened.

In an apparatus disclosed in Japanese Patent Application Laid-Open No. 6-137207, a cleaning member for removing dirt is moved in an axial direction as the need arises so that a brush charger is cleaned.

In a apparatus disclosed in Japanese Patent Application Laid-Open No. 4-366863, a shaft-type thin dirt removing member having electrical conductivity is held in a state that it digs into a brush of a rotating brush charger by a constant amount, and toner particles, which were removing mechanically from the brush charger by the dirt removing member, are adsorbed on an electrode to which a voltage whose polarity is opposite to that of the toner particles was applied.

In an apparatus disclosed in Japanese Patent Application Laid-Open No. 7-072774, after a voltage, which is higher than the main body of a photoreceptor, is applied to a brush, an electrophotographic printer is aged so that dirt on the brush is transferred onto the surface of the photoreceptor so as to be cleaned.

In an apparatus disclosed in Japanese Patent Application Laid-Open No. 10-221932, a voltage whose polarity is opposite to that of a voltage applied the time of forming an image is applied to a brush when an image is not formed so that cleaning is executed.

In an apparatus disclosed in Japanese Patent Application Laid-Open No. 7-306571, a voltage, whose polarity is the same as charging polarity of toner and whose absolute value is small, is applied to a brush of a brush charger when an image is not formed so that dirt on the brush is adsorbed on the surface of a photoreceptor and is cleaned.

Incidentally, electrically conductive brush fiber which is used in a brush charger is made of fine and soft fiber because such fiber does not damage a photoreceptor. Since a contact type brush charger is always contact-pressed against a photoreceptor, if it is influenced by environment or the like, peculiarity such as raising or laying of the brush occurs easily on a boundary between a portion where the brush fiber is pressed and a portion where the brush fiber is not pressed, and such peculiarity is hardly eliminated. At this time, since the brush or the brush type charger contacts uniformly with the surface of the photoreceptor, defective charging is caused, and thus there is a possibility that a defective image is formed with a period of one rotation.

In addition, in a roller-shaped charging brush, dirt such as residual toner, paper powder and photoreceptor shavings is apt to be gradually accumulated towards an inner portion of a brush in the process that the lifetime of a process cartridge ends. Recently, a slanted filling type brush roller, whose brush pile previously is laid in a direction opposite to rotation of the brush roller in order to be proof against peculiarity such as the raising to some degree, is frequently used. In such a slanted filling type brush roller, dirt is strongly apt to be accumulated on the inner part of the brush, and the accumulated dirt cannot be removed sufficiently only by electrical cleaning, and thus there arises a great problem about the extension of the lifetime.

Japanese Patent Application Laid-Open No. 8-254877 discloses a cleaning method which eliminates the above problem. In this cleaning method, dirt which was accumulated on an inner portion of the slanted filling brush is cleaned by oscillation, but a sufficient effect for eliminating the dirt from the inner portion of the brush cannot be expected.

Moreover, Japanese Patent Application Laid-Open No. 7-072774, Japanese Patent Application Laid-Open No. 10-221932 and Japanese Patent Application Laid-Open No. 7 306571 disclose respectively apparatuses for electrically cleaning dirt accumulated on an inner portion of a slanted filling brush, but in these examples cannot produce a sufficient effect.

Japanese Patent Application Laid-Open No. 8-137207 and Japanese Patent Application Laid-Open No. 4-366863 discloses respectively apparatuses having an eliminating member, but in these apparatuses the eliminating member might damage the brush roller and this possibly causes a defective image.

Further, Japanese Patent Application Laid-Open No. 7-104562 discloses a brush roller having a cleaning grid for electrically cleaning dirt accumulated on a slanted filling brush, but cannot produce a sufficient effect.

SUMMARY OF THE INVENTION

The inventor found that it is difficult to correct the peculiarity of a brush and remove dirt of an inner portion of the brush by means of non-uniformly set length of the brush pile or a dirt removing member which digs into a roller-shaped charging brush by a constant amount.

It is an object of the present invention to provide an image forming apparatus which is capable of reducing peculiarity of a roller-shaped charging brush such as raising and laying of brush and of efficiently eliminating dirt accumulated on an inner portion of, particularly, a slanted filling type brush, and of always maintaining a state that a photoreceptor is charged by the roller-shaped charging brush satisfactorily.

In order to overcome the above problems simultaneously, an image forming apparatus for forming an electrostatic latent image on a surface of an electrostatic latent image holder, includes:

- a roller-shaped charging brush for charging the surface of the electrostatic latent image holder while rotating in contact with the surface of the electrostatic latent image holder, wherein brush pile of the roller-shaped charging brush is slanted in a direction opposite to a rotation direction of the roller-shaped charging brush;
- a first member for raising the brush pile and cleaning it while rotating in contact with the roller-shaped charging brush; and
- a second member located at a position following the first member in the rotation direction of the roller-shaped charging brush, for shaping the brush pile raised by the first member while contacting with the roller-shaped charging brush.

A combination of the first and second members can provide a satisfactory charging function at all times. More specifically, when the opposite of the image forming apparatus is stopped, the brush pile of the roller-shaped charging brush is laid due to the contact-press with the electrostatic latent image holder, resulting in the raised and laid portions of the brush pile. In such a state, when the roller-shaped charging brush rotates, the laid portion of the brush pile can be raised. At this time, the inner portion of the brush pile is exposed to the outside, and dirt such as residual toner, paper powder and shavings of the electrostatic latent image holder can be scraped out to be removed efficiently. Thereafter, the brush pile which were raised are slanted by the second member so as to be capable of being shaped satisfactorily, resulting in the predetermined radius of the roller-shaped charging brush. The above process can completely restore the brusch pile which was laid by the contact-press with the electrostatic latent image holder, and can remove dirt from the brush pile without damaging the roller-shaped charging brush. As a result, a high-quality image without defective image can be obtained for a long time, and thus the running cost is reduced.

Preferably, the first member rotates in a direction opposite to the rotation direction of the roller-shaped charging brush, resulting in improved brush restoration and dirt removal. Further, preferably, the first member includes a rotating shaft, and a plurality of ribs which are positioned with intervals of predetermined angle in a peripheral direction of the rotating shaft and are extended along the rotating shaft. This results in improved brush restoration and dirt removal.

The following relationship may be set between the roller-shaped charging brush and the first member:

$$r2 \cdot w2 = A \cdot r1 \cdot w1 \text{ (A is coefficient, and A>1)},$$

where r1 and w1 are a radius and a rotation speed of the roller-shaped charging brush, respectively, and r2 and w2 are a radius and a rotation speed of the first member, respectively. This results in efficiently raising the brush pile.

Preferably, the second member may be a shaping blade which is in contact with the roller-shaped charging brush under a predetermined pressure. This causes the brush to be precisely shaped with simple structure. Further preferably, the electrostatic latent image holder is dug into the roller-shaped charging brush by a first digging amount of e1 and the first member is dug into the roller-shaped charging brush by a second digging amount of e2, wherein a following relationship is set between the first and second digging amounts e1 and e2: 32>e1. This results in efficiently raising the brush pile. The shaping blade may be shaped like teeth of a comb, resulting in improved shaping effect. Alternatively, at least end portion of the shaping blade may be made of an elastic material, resulting in improved shaping effect.

The second member may be a shaping roller which is in contact with the roller-shaped charging brush while rotating in a direction identical with the rotation direction of the roller-shaped charging brush. This causes the brush to be precisely shaped. More specifically, the electrostatic latent image holder is dug into the roller-shaped charging brush by a first digging amount of e1, the first member is dug into the roller-shaped charging brush by a second digging amount of e2, the shaping roller is dug into the roller-shaped charging brush by a third digging amount of e4, wherein a following relationship is set among the roller-shaped charging brush, the first member, and the shaping roller:

$$r2 \cdot w2 = B \cdot r1 \cdot w1 \text{ (B is coefficient, and B>1)},$$

$$r4 \cdot w4 \geqq 0,$$

$$e2 > e1, \text{ and}$$

$$e4 = 0,$$

where r1 and w1 are a radius and a rotation speed of the roller-shaped charging brush, respectively, r2 and w2 are a radius and a rotation speed of the first member, respectively, and r1 and w1 are a radius and a rotation speed of the shaping roller, respectively. This results in efficiently raising the brush pile and precisely shaping the raised brush pile.

Further, the first member may be movable between a contact position and a non-contact position. This causes the cleaning to be made as necessary. Similarly, the second member may be movable between a contact position and a non-contact position. This causes the brush shaping to be made as necessary.

DETAILED DESCRIPTION OF THE PREFERRED EMBODIMENTS

Figure 1:
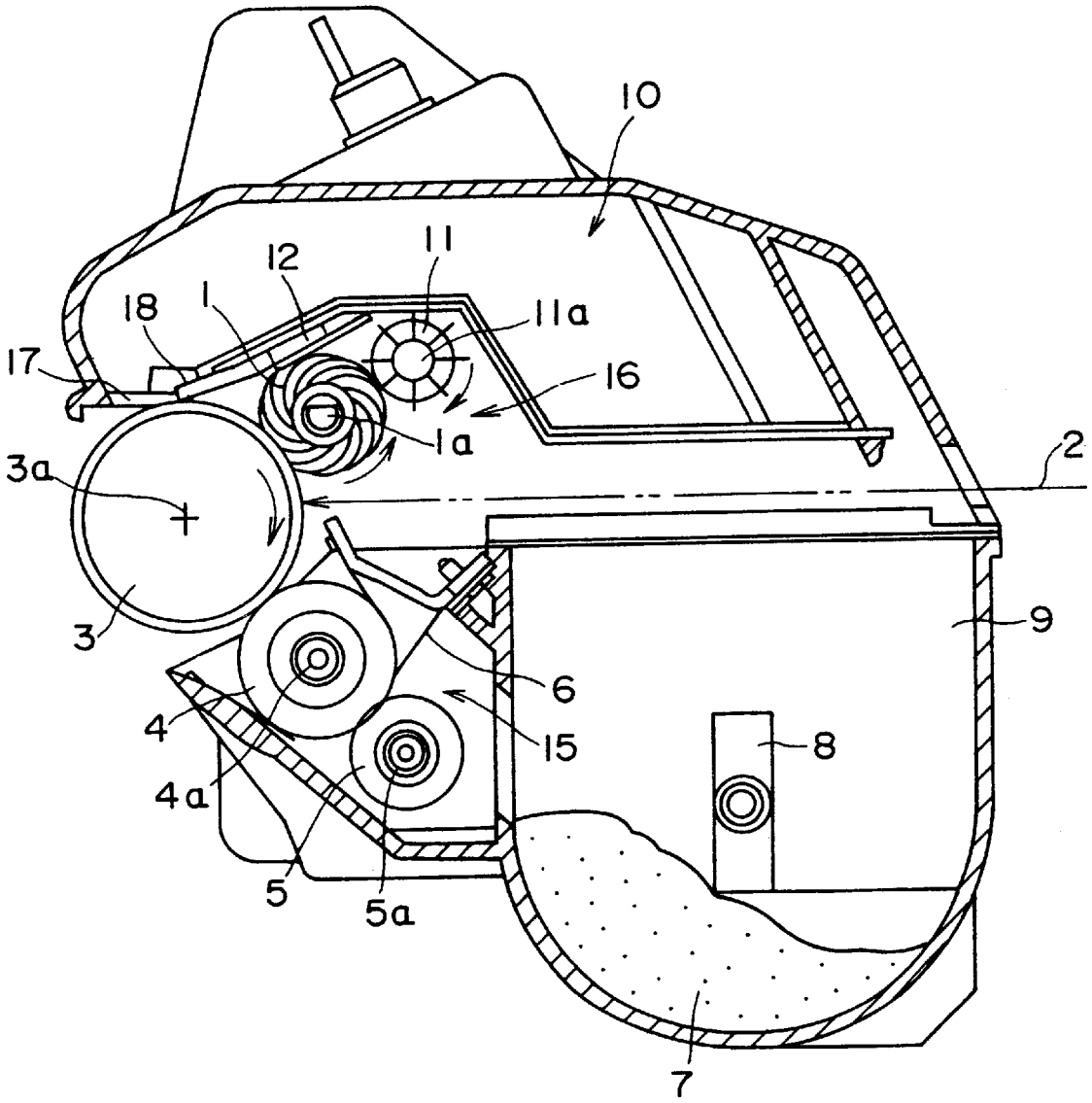
FIG. 1 is a sectional view showing a process cartridge of an image forming apparatus according to a first embodiment of the present invention which is cut along a direction crossing perpendicularly to a rotating shaft of a photoreceptor drum.

Referring to FIG. 1, a process cartridge includes a photoreceptor drum (electrostatic latent image holder) 3 which rotates in a clockwise direction about a rotating shaft 3*a*, and further includes a toner feed chamber 15 and a toner hopper 9 for feeding toner to the toner feed chamber 15 in a position below the photoreceptor drum 3. A combination of the toner feed chamber 15 and the toner hopper 9 composes an image developing section.

In the photoreceptor drum 3, a photoreceptor film made of a material such as OPC (Organic Photor conductor), Sc base or the like is formed on a surface of an aluminum pipe. The process cartridge further has a cleaning chamber 10 and a cleaning mechanism 16. A toner image left on the surface of the photoreceptor drum after transferring the image onto a recording medium is scraped off and is accumulated in the cleaning chamber 10. The cleaning mechanism 16 eliminates toner particles adhered to the roller-shaped charging brush 1 in a position above the photoreceptor drum 3.

The toner feed chamber 15 is provided with a developing roller 4 which faces the photoreceptor drum 3 and has a rotating shaft 4*a* parallel with the rotating shaft 3*a*, a feed roller 5 which faces the developing roller 4 and has a rotating shaft 5*a* parallel with the rotating shaft 4*a*, and a toner blade 6 whose end contacts with the developing roller 4 and which is extended in a direction of the rotating shaft of the photoreceptor drum 3. The toner hopper 9 is provided with a toner mixer 8 for agitating housed toner 7.

The feed roller 5 is made of a material such as sponge or aluminum having electrical conductivity or insulating properties, and feeds the toner 7 from the toner hopper 9 to the developing roller 4. The developing roller 4 is made of a flexible material including a member such as silicon rubber, urethane rubber, nitrile butylene rubber, natural rubber or sponge whose surface is processed. One or more toner blades 6 are provided, and the toner blade 6 is made of metallic elastic material such as stainless, phosphor bronze or nickel silver.

The cleaning chamber 10 is composed of a space formed above the cleaning mechanism 16 in the process cartridge, and it has a toner admission opening 17 formed in a specified position above the photoreceptor drum 3, and a toner scraping-off member 18 whose end is brought into contact with an upper surface of the photoreceptor drum 3 and scrapes off image toner from the photoreceptor drum 3 rotation in the clockwise direction. The toner scraped off by the toner scraping-off member 18 enters the cleaning chamber 10 from the toner admission opening 17 so as to be housed.

The cleaning mechanism 16 has the roller-shaped charging brush 1 which rotates in a counterclockwise direction about a shaft 1*d* to be a rotating shaft parallel with the rotating shaft 3*a*, a brush cleaner 11 which rotates in the clockwise direction about a sleeve shaft 11*a* to be a rotating shaft parallel with the shaft 1*a*, and shaping blade 12 which contacts with the rotating roller-shaped charging brush 1 from above.

The roller-shaped charging brush 1 is made of semiconductive fiber, and applies a superposed voltage of DC and AC voltages to the photoreceptor drum 3 so as to uniformly charge the drum surface to an initial potential. The shaping blade 12 is extended in the direction of the rotating shaft of the roller-shaped charging brush 1, namely, is of a plate type, and the shaping blade 12 is pressed against an upper portion of the roller-shaped charging brush 1 by energizing or force applying means (not shown).

Figure 2A:
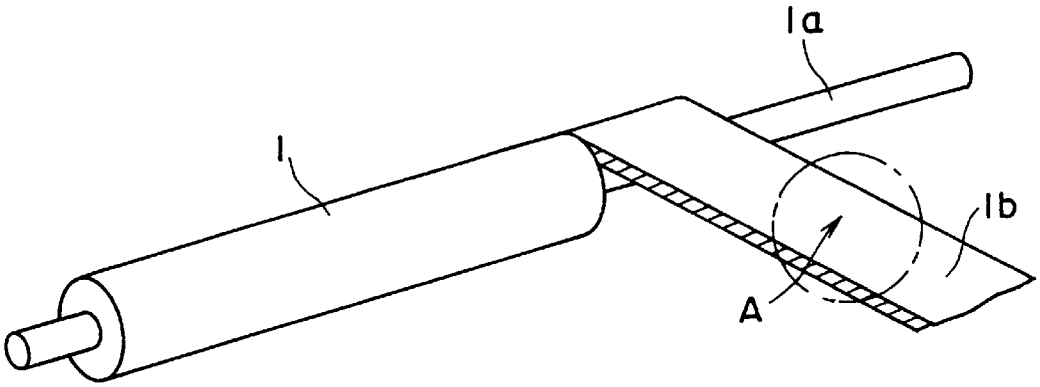
FIG. 2A is a perspective view showing a structure of a roller-shaped charging brush according to the first embodiment.

Referring to FIG. 2A, a brush 1*b* is partially peeled from the shaft 1*a* composing the rotating shaft. The roller-shaped charging brush 1 is composed of the shaft 1*a* and the brush 1*b*, and the brush 1*b* is made of a woven material composed of a conductive fiber, and the brush 1*b* is wound around the shaft 1*a* spirally without gap.

Figure 2B:
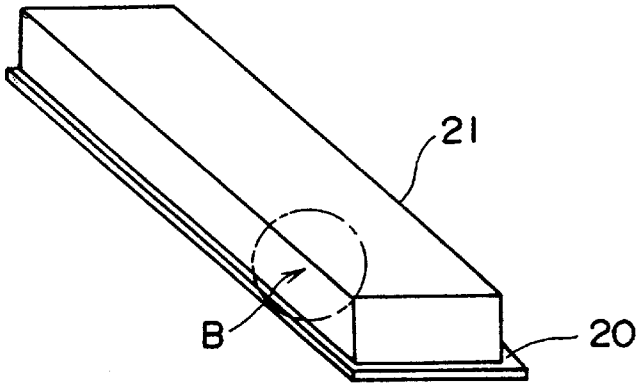
FIG. 2B is an enlarged perspective view showing a circled portion of a brush represented by an arrow A in FIG. 2A.

Referring to FIG. 2B, the brush has a lot of brush piles 21 which are planted into a substrate member 20 in vertical and horizontal directions at specified intervals. A lot of brush piles 21 are formed so as to have the same length, and are laid in a constant direction (for example, an inner direction on the paper in the diagram), namely, composed into a slanted filling shape.

Figure 2C:
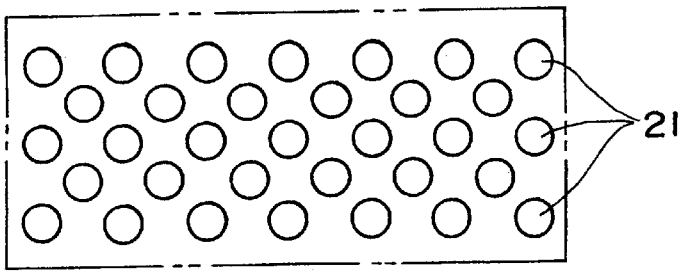
FIG. 2C is an enlarged plan view showing a circled portion of an enlarged brush structure of FIG. 2B represented by an arrow B.

Referring in FIG. 2C, the brush piles 21 are planted into the substrate member 20 in vertical and horizontal directions at specified intervals.

Figure 3:
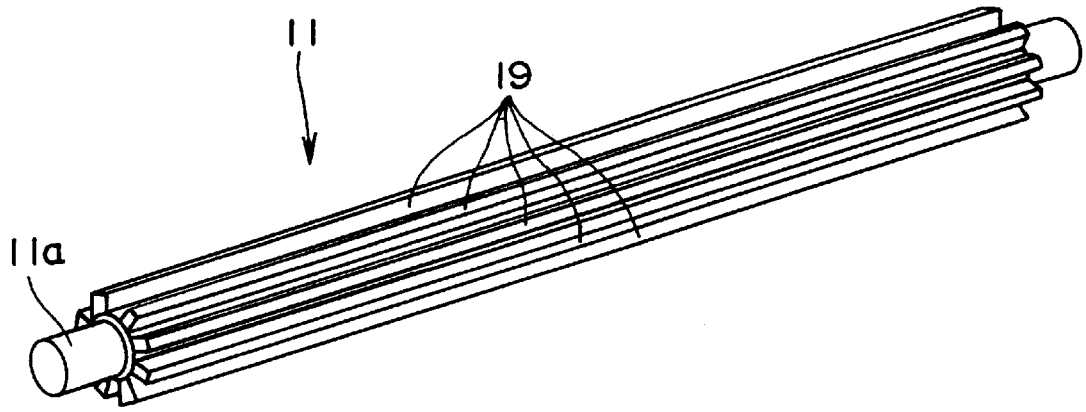
FIG. 3 is a perspective view showing a whole structure of a brush cleaner according to the first embodiment.

As shown in FIG. 3, the brush cleaner 11 has a predetermined number (n) of blade-shaped ribs 19 which are positioned in a peripheral direction of a cylindrical sleeve shaft 11*a* with intervals of specified angle and are extended in the direction of the rotating shaft.

Hereafter, an example of the roller-shaped charging brush 1 will be described.

Figure 4:
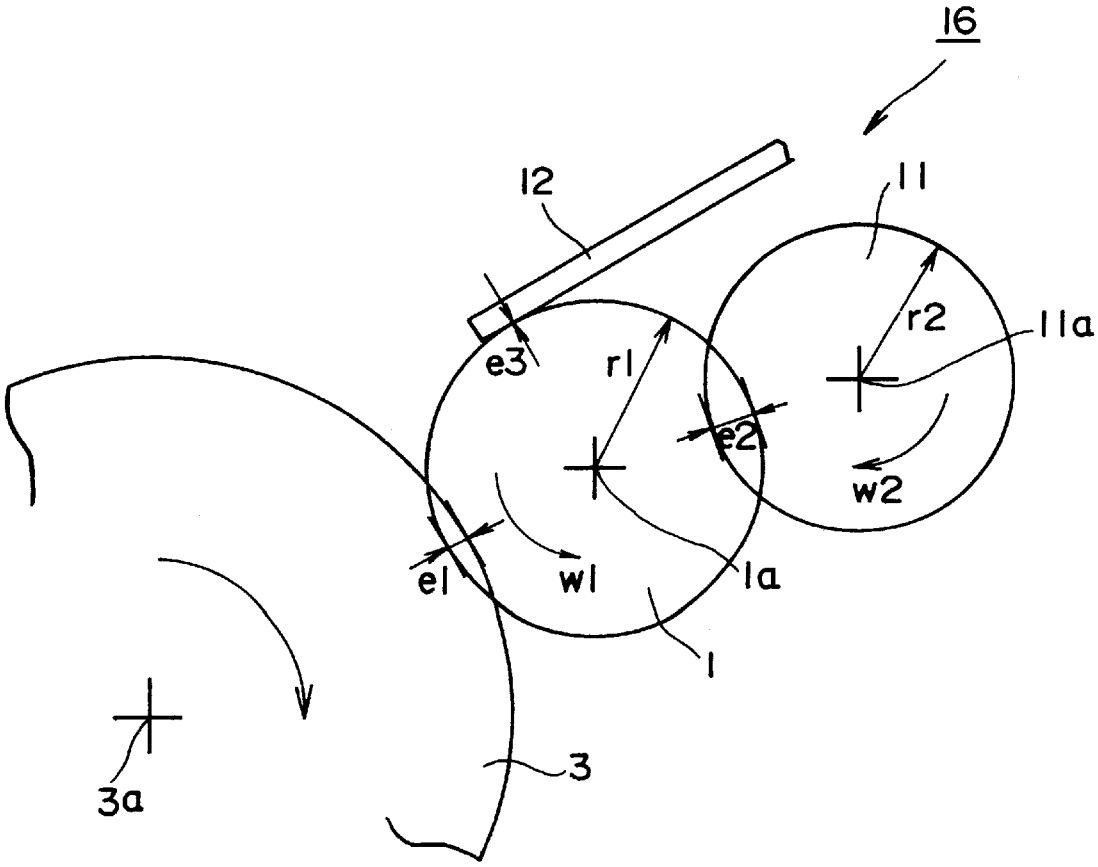
FIG. 4 is a side view schematically showing respective members of a cleaning mechanism described in FIG. 1.

Referring to FIG. 4, the roller-shaped charging brush 1 has a structure that its radius is r1 [mm] and rotation speed is w1 [rpm] and it rotates in the counterclockwise direction in the diagram, and an amount that the photoreceptor drum 3 which rotates in the clockwise direction is dug into the roller-shaped charging brush 1 is set to e1 [mm].

The brush cleaner 11 has a structure that its radius is r2 [mm] and rotation speed is w2 [rpm] and it rotates in the counterclockwise direction in the diagram, and an amount that it cuts into the roller-shaped charging brush 1 with radius of r1 [mm] which rotates in the counterclockwise direction is set to e2 [mm].

As for the shaping blade 12 which contacts with the roller-shaped charging brush 1 from above, an amount that it cuts into the roller-shaped charging brush with radius of r1 [mm] is set to e3 [mm]. The shaping blade 12 contacts with the surface of the roller-shaped charging brush 1 at a specified pressure, its forward end can be formed into a comb tooth shape. Moreover, at least the forward end may be composed of an elastic material.

The cleaning mechanism 16 having the above structure is operated in the following manner, in a state that the roller-shaped charging brush 1 and the brush cleaner 11 are dug into each other by the digging amount e2 [mm], the roller-shaped charging brush 1 rotates at w1 [rpm] and the brush cleaner 11 rotates at w2 [rpm] in directions opposite to each other. In this case, a relationship r2·w2=A·r1·w1 (A is coefficient, and A>1) is set between the roller-shaped charging brush 1 and the brush cleaner 11 so that the roller-shaped charging brush 1 whose brush piles 21 were partly laid due to press-contact with the photoreceptor drum 3 is subject to the raising process. At the same time, the cleaning can be executed satisfactorily in such a manner that dirt such as residual toner, paper powder which entered the inner portion of the brush piles 21 and shavings of the photoreceptor drum 3 is scraped out.

Next, the roller-shaped charging brush 1 whose brush piles 21 were raised by the brush cleaner 11 is pressed by the shaping blade 12 positioned on the backward stream side so that the brush piles 21 are slanted, and the roller-shaped charging brush 1 is shaped into the original state that the radius is r1 [mm] so as to be reconstructed. At this time, in order to completely realize the raising by the brush cleaner 11 and the shaping by the shaping blade 12, the following relationships may be established among the digging amounts e1, e2 and e3:

e2>e1, and e3=0,

There will be described below a whole operation of the image processing apparatus. At first, the toner 7 housed in the toner hopper 9 is led to the feed roller 5 by the rotating toner mixer 8 and is led to the developing roller 4. The toner 7 led to the developing roller 4 is formed into a uniform thin layer by the toner blade 6 and is charged by friction. During this process, the photoreceptor drum 3 is subject to exposure to a light beam 2 moduled according to image data from a light source such as laser, LED or liquid-crystal light source so that an electrostatic latent image is formed on its surface. Further, since the charged thin-layer toner 7 adhered on the developing roller 4 is adhered to the electrostatic latent image of the photoreceptor drum 3, the electrostatic latent image is developed so that a toner image is formed thereon.

Next, the toner image on the photoreceptor drum 3 is transferred onto a recording medium such as recording paper, OHP film or post card by a transfer mechanism (not shown), and the toner image transferred onto the recording medium is fixed to the recording medium by a fixing mechanism (not shown). As a result, a desired image can be obtained. Residual toner, which is not transferred onto the recording medium remains on the surface of the photoreceptor drum 3 at the time of the transferring, collected by the cleaner 10.

During the transferring and fixing operations, the brush cleaner 11 rotates in a constant speed relationship with respect to the roller-shaped charging brush 1 which contacts with the photoreceptor drum 3, and the shaping blade 12 contacts with the roller-shaped charging brush 1 at a constant pressure. As a result, the roller-shaped charging brush 1 whose brush piles are laid is subject to the raising process, and residual toner which entered to inner portion of the brush piles 31 is scraped out so that the cleaning can be executed.

There will be described a second embodiment of the present invention hereinafter.

Figure 5:
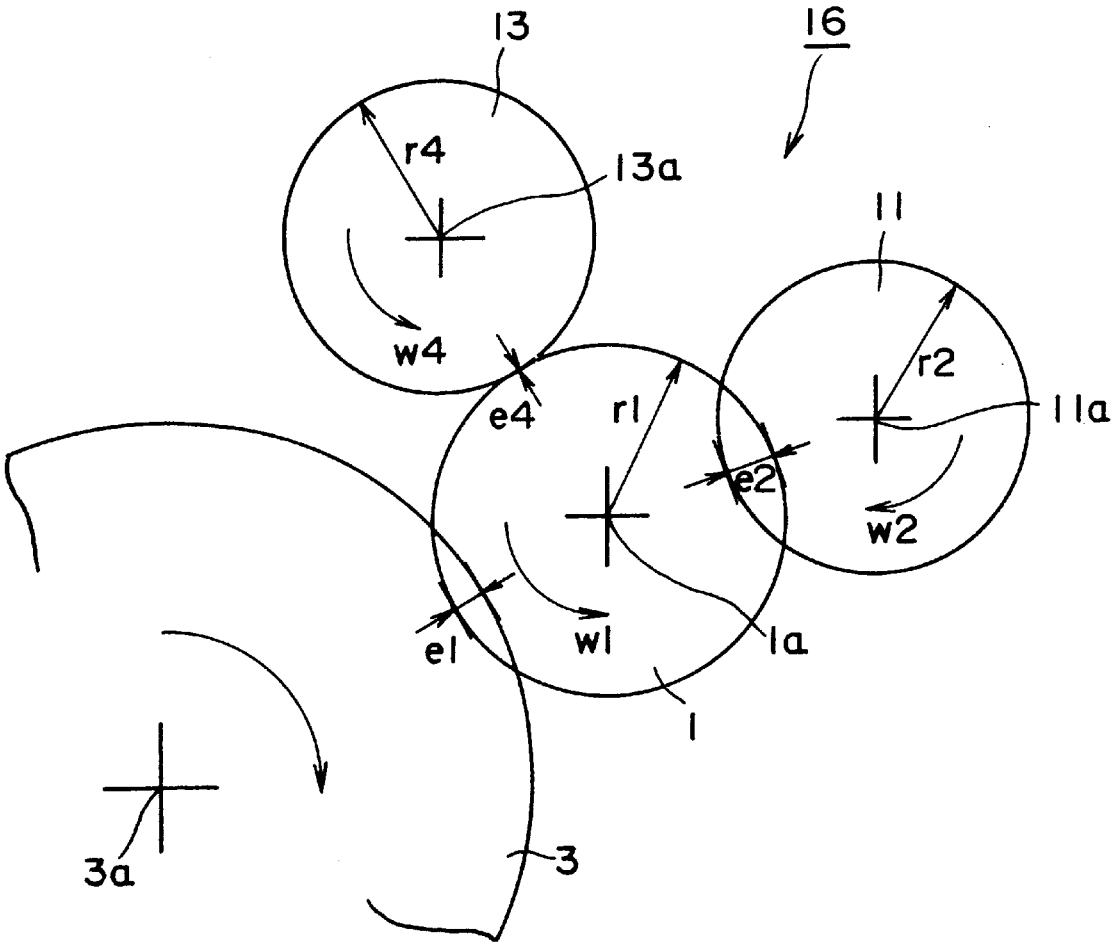
FIG. 5 is a side view schematically showing respective members of a cleaning mechanism according to a second embodiment of the present invention.

Referring to FIG. 5, the shaping blade 12 used in the first embodiment is replaced with a shaping roller 13. Namely, in the second embodiment, the shaping roller 13, which contacts with the upper portion of the roller-shaped charging brush 1 at a specified pressure, is provided. The shaping roller 13 has a rotating shaft 13*a* which is extended in the direction of the rotating shaft of the brush type charged body 1, and is preferably made of an elastic material such as engineering plastics, rubber or sponge.

For example, respective dimensions are set as follows. As for the shaping roller 13, its radius is set to r4 [mm] and an amount that it digs into the roller shaped charging brush 1 with radius of r1 [mm] is set to e4 [mm]. The shaping roller 13 is set so as to rotate with rotation speed w4 [rpm] about a rotating shaft 13*a* in the direction same as the rotating direction of the roller-shaped charging brush 1. The shaping roller 13 is not limited to the rotating structure, and it can be held in a fixed state that it contacts with the roller-shaped charging brush 1 at a specified pressure. Also in this case, the effect which is similar to the case that the shaping roller 13 rotates can be obtained.

The following relationships are set among the roller-shaped charging brush 1, the brush cleaner 11 and the shaping roller 13:

$r2 \cdot w2 = B \cdot r1 \cdot w1$ (B is coefficient, and B>1), $r4 \cdot w4 \geqq 0$, e2>e1, and e4=0.

According to the second embodiment, as described before, the raising of the brush piles 21 in the roller-shaped charging brush 1 can be eliminated to prevent defective charging, and dirt collected in the inner portion of the slanted brush piles 21 can be removed efficiently. Therefore, charging of the photoreceptor drum 3 by the roller-shaped charging brush 1 is always maintained satisfactorily.

Figure 6:
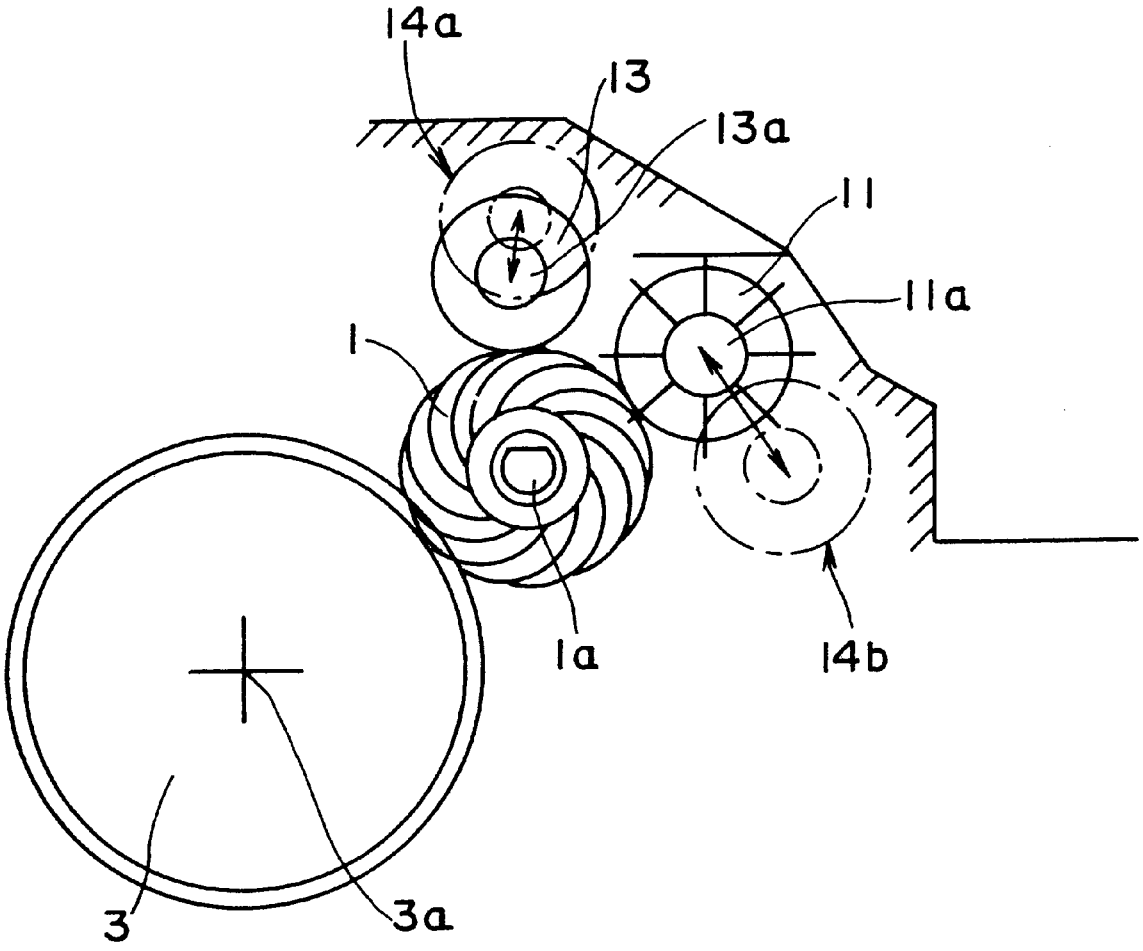
FIG. 6 is a side view showing respective members of a cleaning mechanism according to a third embodiment of the present invention.

FIG. 6 shows a cleaning mechanism 16 according to a third embodiment of the present invention. In the first and second embodiments, the shaping blade 12, the shaping roller 13 and the brush cleaner 11 always contact with the roller-shaped charging brush 1, but in the third embodiment, the shaping roller 13 and the brush cleaner 11 are movable forward or backward with respect to the roller-shaped charging brush 1 as the need arises. The present embodiment describes only the shaping roller 13, but the shaping blade 12 can be moved forward or backward instead of the shaping roller 13.

As shown in FIG. 6, the brush cleaner 11 and the shaping roller 13 have respectively mechanisms which make the brush cleaner 11 and the shaping roller 13 retreat respectively to escape or non-contact areas 14*a* and 14*b*. As a result, for example, while the rotation of the roller-shaped charging brush 1 stops, namely, the cleaning is not executed, the brush cleaner 11 and the shaping roller 13 are moved from the roller-shaped charging brush 1, and thus inconvenience that the brush piles 21 are deformed by the press-contact with the brush cleaner 11 and the shaping roller 13 can be eliminated.

It is not necessary for the roller-shaped charging brush 1 to be always cleaned, and the cleaning timing can be set at desired timing such as every time printing onto one recording sheet is completed or when the power source of the image forming apparatus (printer) is turned on. In this case, the following relationships are established among the roller-shaped charging brush 1, the brush cleaner 11 and the shaping roller 13:

$r2 \cdot w2 = A \cdot r1 \cdot w1$ (A is coefficient, A>1), e2>e1, and e3=0.

Or the following relationships are established between the brush cleaner 11 and the shaping blade 12:

$r2 \cdot w2 = A \cdot r1 \cdot w1$ (A>1).

$r4 \cdot w4 \geqq 0$, e2>e1, and c4=0.

According to the first through third embodiments, when the roller-shaped charging brush 1 rotates, the brush cleaner 11 rotates in the opposite direction at a speed higher than that of the roller-shaped charging brush 1. As a result, the brush piles 21 of the roller-shaped charging brush 1 which were laid due to the contact-press with the photoreceptor drum can be raised. At this time, the inner portion of the brush piles 21 is exposed to the outside, and dirt such as residual toner, paper powder and shavings of the photoreceptor can be scraped out to be removed efficiently.

Next, the brush piles 21 of the roller-shaped charging brush 1 which were raised are slanted by the shaping blade 12 so as to be capable of being shaped satisfactorily, resulting in the predetermined radius of the roller-shaped charging brush 1. The above process can completely restore the brush pile which was laid by the contact-press with the photoreceptor drum 3 or the like, and can remove dirt from the brush pile without damaging the roll type brush charged body 1. As a result, a high-quality image without defective image can be obtained for a long time, and thus the running cost is reduced.

The present invention was described based on the suitable embodiments, but the image forming apparatus of the present invention is not limited only to the structures in the above-mentioned embodiments. An image forming apparatus which is obtained by variously modifying the structures in the above embodiments is also included in the scope of the present invention.

As mentioned above, according to the image forming apparatus of the present invention, the raising and laying of the roller-shaped charging brush hardly occur, and dirt accumulated in the inner portion of the slanted type brush can be eliminated efficiently. Therefore, the charging state of the photoreceptor by the roller-shaped charging brush can be always maintained satisfactorily.

What is claimed is:

1. An image forming apparatus for forming an electrostatic latent image on a surface of an electrostatic latent image holder, comprising:

a roller-shaped charging brush for charging the surface of the electrostatic latent image holder while rotating in contact with the surface of the electrostatic latent image holder, wherein brush pile of the roller-shaped charging brush is slanted in a direction opposite to a rotation direction of the roller-shaped charging brush;

a first member for raising the brush pile and cleaning it while rotating in contact with the roller-shaped charging brush; and a second member located at a position following the first member in the rotation direction of the roller-shaped charging brush, for shaping the brush pile raised by the first member while contacting with the roller-shaped charging brush.

2. An image forming apparatus according to claim 1, wherein the first member rotates in a direction opposite to the rotation direction of the roller-shaped charging brush.

3. An image forming apparatus according to claim 2, wherein the first member comprises:

a rotating shaft; and a plurality of ribs which are positioned with intervals of predetermined angle in a peripheral direction of the rotating shaft and are extended along the rotating shaft.

4. An image forming apparatus according to claim 2, wherein a following relationship is set between the roller-shaped charging brush and the first member:

$r2 \cdot w2 - A \cdot r1 \cdot w1$ (A is coefficient, A>1), where r1 and w1 are a radius and a rotation speed of the roller-shaped charging brush, respectively, and r2 and w2 are a radius and a rotation speed of the first member, respectively.

5. An image forming apparatus according to claim 3, wherein a following relationship is set between the roller-shaped charging brush and the first member:

$r2 \cdot w2 = A \cdot r1 \cdot w1$ (A is coefficient, A>1), where r1 and w1 are a radius and a rotation speed of the roller-shaped charging brush, respectively, and r2 and w2 are a radius and a rotation speed of the first member, respectively.

6. An image forming apparatus according to claim 1, wherein the second member comprises:

a shaping blade which is in contact with the roller-shaped charging brush under a predetermined pressure.

7. An image forming apparatus according to claim 6, wherein the electrostatic latent image holder is dug into the roller-shaped charging brush by a first digging amount of e1 and the first member is dug into the roller-shaped charging brush by a second digging amount of e2, wherein a following relationship is set between the first and second digging amounts e1 and e2: e2>e1.

8. An image forming apparatus according to claim 6, wherein the shaping blade is shaped like teeth of a comb.

9. An image forming apparatus according to claim 6, wherein at least end portion of the shaping blade is made of an elastic material.

10. An image forming apparatus according to claim 1, wherein the second member comprises:

a shaping roller which is in contact with the roller-shaped charging brush while rotating in a direction identical with the rotation direction of the roller-shaped charging brush.

11. An image forming apparatus according to claim 10, wherein the electrostatic latent image holder is dug into the roller-shaped charging brush by a first digging amount of e1, the first member is dug into the roller-shaped charging brush by a second digging amount of e2, the shaping roller is dug into the roller-shaped charging brush by a third digging amount of e4, wherein a following relationship is set among the roller-shaped charging brush, the first member, and the shaping roller:

$r2 \cdot w2 - B \cdot r1 \cdot w1$ (B is coefficient, and B>1), $r4 \cdot w4 \geqq 0$, $e2 > e1$, and $e4 = 0$ wherein r1 and w1 are a radius and a rotation speed of the roller-shaped charging brush, respectively, r2 and w2 are a radius and a rotation speed of the first member, respectively, and r4 and w4 are a radius and a rotation speed of the shaping roller, respectively.

12. An image forming apparatus according to claim 1, wherein the first member is movable between a contact position and a non-contact position.

13. An image forming apparatus according to claim 1, wherein the second member is movable between a contact position and a non-contact position.

14. In an image forming apparatus for forming an electrostatic latent image on a surface of an electrostatic latent image holder, having a roller-shaped charging brush for charging the surface of the electrostatic latent image holder while rotating in contact with the surface of the electrostatic latent image holder, wherein brush pile of the roller-shaped charging brush is slanted in a direction opposite to a rotation direction of the roller-shaped charging brush, a method for shaping the brush pile of the roller-shaped charging brush, comprising the steps of:

rotating a brush cleaner in contact with the brush pile of the roller-shaped charging brush to raise the brush pile and cleaning it; and contacting a shaping member with the brush pile raised to shape the brush pile.

* * * * *